US005184808A

United States Patent [19]

Vesper

[11] Patent Number: 5,184,808

[45] Date of Patent: Feb. 9, 1993

[54] FENCE WALL CONSTRUCTION

[76] Inventor: Dale E. Vesper, 4701 Hazel Ave., Holiday, Fla. 33856

[21] Appl. No.: 178,261

[22] Filed: Apr. 6, 1988

[51] Int. Cl.[5] ..... E04H 17/16

[52] U.S. Cl. ..... 256/31; 256/24; 256/73

[58] Field of Search ..... 52/793, 309.7, 309.17, 52/809, 281; 256/19, 24, 31, 73, DIG. 5; 106/90

[56] References Cited

U.S. PATENT DOCUMENTS

| | | | |
|---|---|---|---|
| 844,296 | 2/1907 | Winslow | 52/169.14 |
| 2,664,740 | 1/1954 | Cochrane | 52/281 |
| 3,313,073 | 9/1962 | Mathews | 52/309.7 |
| 3,376,629 | 4/1968 | Baumann et al. | 52/309.17 |
| 3,500,602 | 1/1968 | Ueno | 52/169.7 |
| 4,062,822 | 12/1977 | Lesage | 106/90 |
| 4,193,584 | 3/1980 | Weiser | 256/24 X |
| 4,194,919 | 3/1980 | Hattori et al. | 106/90 |
| 4,249,950 | 2/1981 | Hurst | 106/90 |
| 4,288,962 | 9/1981 | Kavanaugh | 52/220 |
| 4,390,372 | 6/1983 | Hardin | 106/90 |
| 4,649,682 | 3/1987 | Barrett | 52/601 |
| 4,896,469 | 1/1990 | Wright . | |

FOREIGN PATENT DOCUMENTS

| | | | |
|---|---|---|---|
| 222827 | 1/1958 | Australia | 256/19 |

*Primary Examiner*—Andrew V. Kundrat
*Attorney, Agent, or Firm*—Charles A. McClure

[57] ABSTRACT

Fence wall construction materials, method, and resulting wall. Flanged fence posts spaced apart at intervals corresponding to the end-to-end length of wall panels have their vertical edges slotted to accommodate the post flanges. Preferably the posts are I-beams or back-to-back C-members, and the panels are preformed lightweight material, such as foamed polystyrene, doubly slotted on their vertical edges to sandwich the post flanges within the slots.

8 Claims, 3 Drawing Sheets

FENCE WALL CONSTRUCTION

FIELD OF THE INVENTION

This invention relates to construction of fence walls for physical and visual separation of adjacent sites, and concerns particularly increased durability and increased economy of such walls.

BACKGROUND OF THE INVENTION

Most fences and walls, including fence walls, look fine when just installed. However, many tilt, sag, and crack as time passes and the underlying support shifts slightly under the weight of the materials used. There is a need for a more durable structure, and some innovators have made related contributions. Russo in U.S. Pat. No. 3,869,109 discloses I-beam posts with hardware to retain his frame members. Totten in U.S. Pat. No. 4,007,919 teaches hollow I-beam posts with interlocking hollow rails filled with plastic. Kavanaugh in U.S. Pat. No. 4,288,962 discloses a wall made by affixing plasterboard to the exterior of aligned flanges (perforated) of metal I-beams, and spraying plastic foam to coat the flange-adjacent surface of such board and to fill in until flush, and finally coats the exterior with adhesive and then with stucco. However, these approaches fail to provide the combination of features that my invention offers.

SUMMARY OF THE INVENTION

In general, the objects of the present invention are met placing a plurality of flanged fence posts upright and on centers spaced apart at successive intervals, providing a plurality of wall panels of such interval length with slots along their ends to receive such post flanges, and inserting such panels between adjacent pairs of such posts with such flanges received within such slots. More particularly, such panels are coated with a layer of cementitious material, preferably (in some embodiments) after being covered with wire screen anchored to the fence posts.

A primary object of this invention is to provide a more durable fence wall than is conventionally available.

Another object of the invention is to provide a unique combination of lightness in weight and strength of result.

A further object is to improve the appearance of fence walls useful as screens or buffers in many neighborhoods.

Yet another object is to accomplish the foregoing objects more economically than lesser results are attained nowadays.

Other objects of this invention, together with means and methods for attaining the various objects, will be apparent from the following description and the accompanying diagrams, which are presented by way of example rather than limitation.

DETAILED DESCRIPTION

Figure 2:
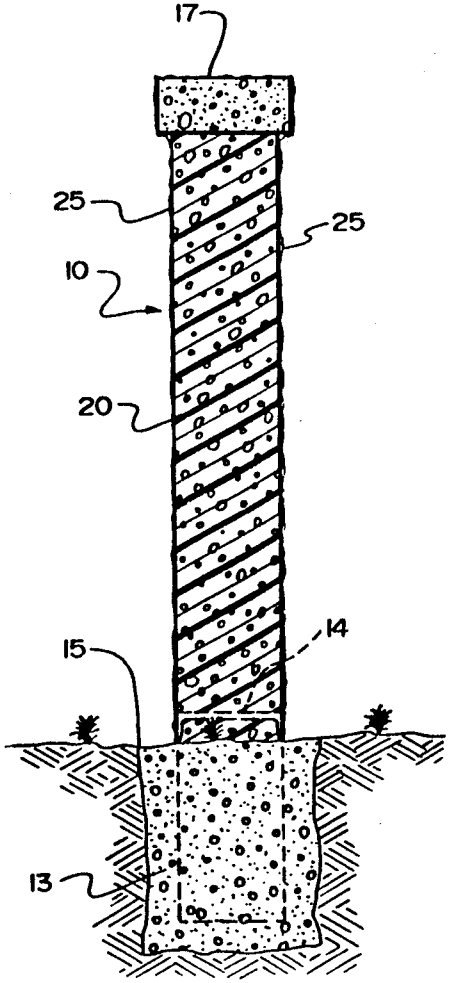
FIG. 2 is a transverse section through such a wall, between supporting posts.
Figure 1:
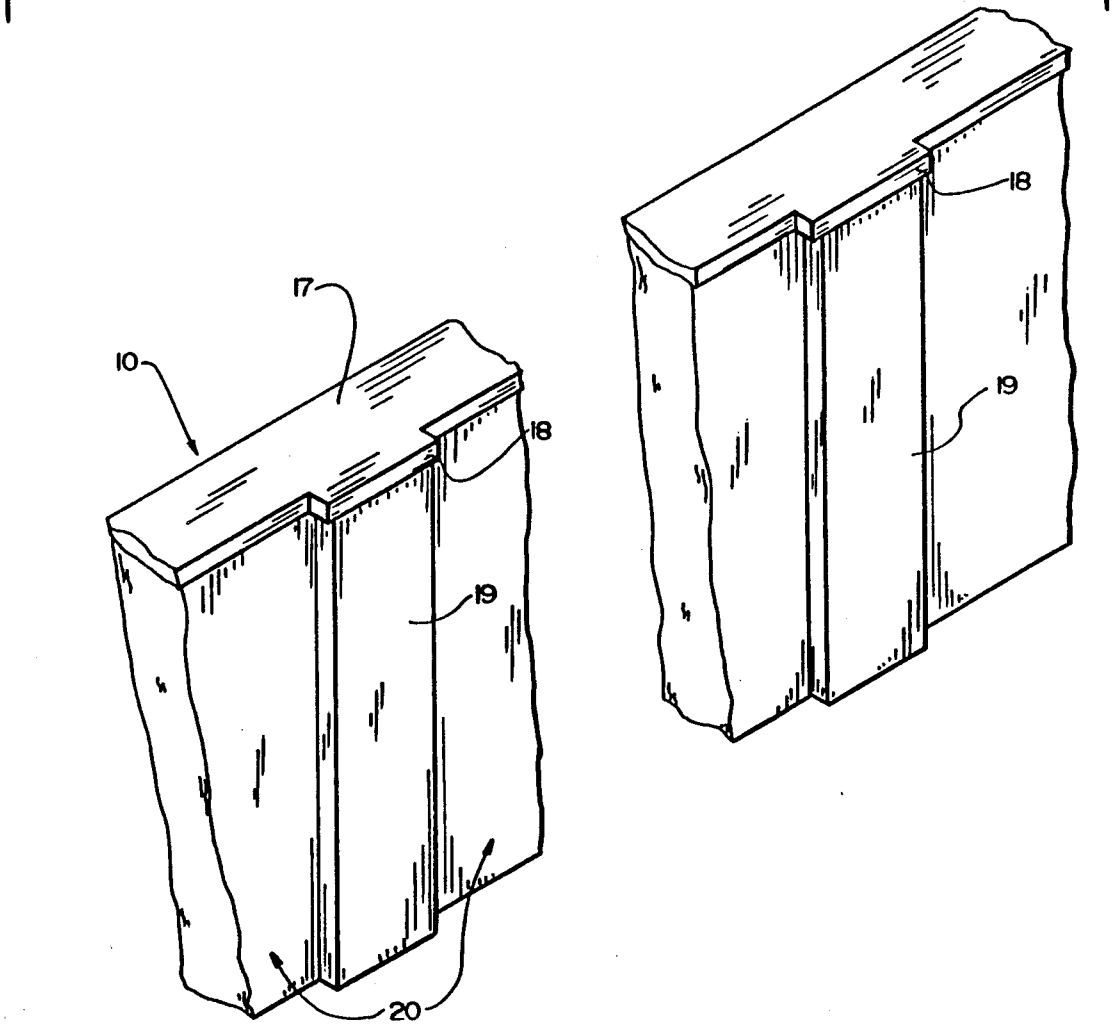
FIG. 1 is a perspective view of a fence wall of this invention.

FIG. 1 shows in perspective a relatively short section of a fence wall 10 of this invention. FIG. 2 shows the same structure in transverse section through such a panel. Such fence features a succession of panels 20 upstanding above ground level 15. Each pair of adjacent panels has a supporting post 12 intervening but invisible from the exterior. Each such post extends also below ground into a footing 13. Cap 17, shown with occasional sidelong rectangular extensions 18 to the near side, overlies the fence wall of FIGS. 1 and 2 and its similarly located decorative pilasters 19. In sectional FIG. 2 the cap is shaded for plastic material, the panel for foamed plastic, and the footing for concrete. At about ground level, stop 14 in the form of an inverted transverse channel piece fits within and is secured, as by welding, within a vertical channel of the post to support the adjacent end of the near panel. The opposite channel on the far side of the post has a like stop (not shown). Both sides of the panel are covered by protective material 25, shown with an irregular stucco-like surface.

Figure 3:
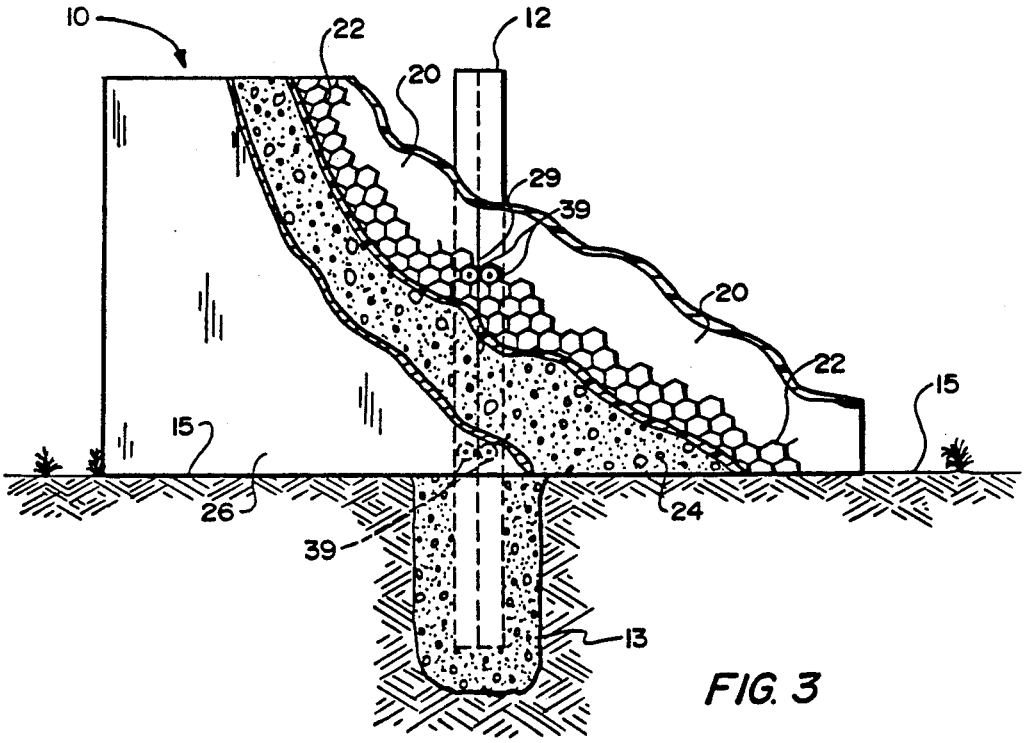
FIG. 3 is a fragmentary side elevation of such fence wall in the vicinity of a supporting post, omitting any cap portion, and successively cut away intermediately to show layered components, also sectioned underground.
Figure 4:
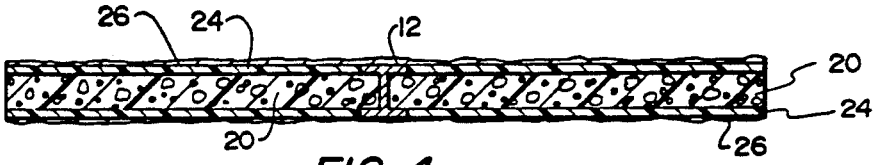
FIG. 4 is a sectional plan of a portion of the same fence wall.

FIG. 3 shows, in successively cut-away layers, and FIG. 4 in fragmentary sectional plan, part of fence wall 10 (less cap). Pair of panels 20 flank single post 12 (upstanding from footing 13) with the adjacent edges of their visible surfaces abutting one another along vertical slit 29. Open-mesh reinforcing fabric or screen 22 covers the panel surface, being anchored to the posts by suitable means such as overlying flat-headed self-tapping screws 39 driven at intervals into the post flanges.

Layered protective material (formerly denoted generally as 25) on the outer surface of panels 20 is shown here as made up of inner layer or base coat 24 of cementitious material (described below) covered in turn by optional outer layer or finish coat 26 of finer or differently colored material (also considered below).

Figure 5:
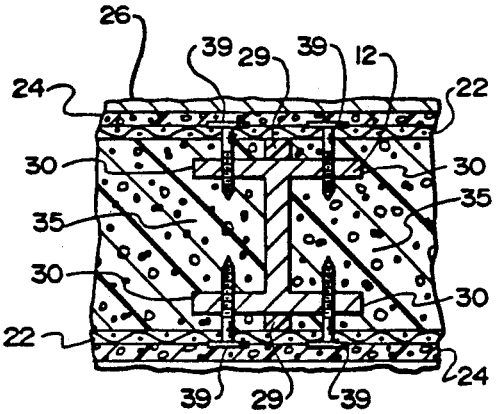
FIG. 5 is a detail view of the post and vicinity of FIG. 4.

FIG. 5 is an enlarged detail view of the post and vicinity of FIG. 4, showing post 12 to have an H-shaped transverse cross-section; such a double channeled member is often called an "I-beam" and is a common item in many kinds of construction. Although not so shown here, such post may be composed of two channel members (C-shaped in section) secured together back to back. Panels 20 at its opposite sides are doubly slotted vertically on their ends to receive the two side flanges of the post I-beam, with tenon 35 between slots 30 fitting into the respective adjacent channels. As shown, each such slot is bounded by a pair of like sides within the panel interior (spaced apart slightly more than the post flange thickness) plus a base at a depth from the panel vertical edge slightly greater than the horizontal extent of a post flange received therein (to be substantially entirely concealed thereby). Recessing of an edge portion of a panel face does not qualify as a "slot" as so defined. The overlying or outer surface portions of the panels abut one another along their edges with slit 29 therebetween concealing the flanges therein. The panel faces are otherwise covered by open-mesh fabric 22, and all overlain in turn by respective inner and outer layers of protective material 24 and 26.

Figure 6:
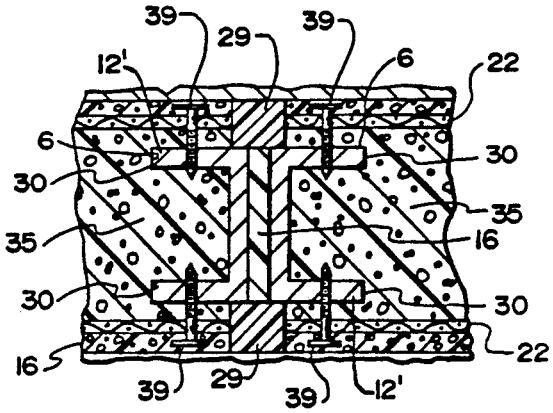
FIG. 6 is a similar detail view in the vicinity of a modified post embodiment.
Figure 7:
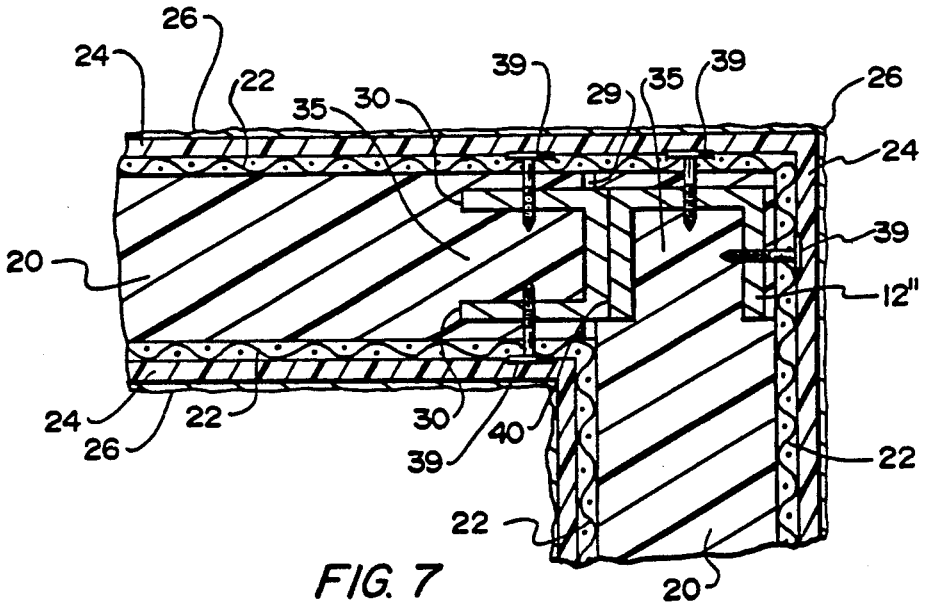
FIG. 7 is a similar detail view of a corner post embodiment.

FIGS. 6 and 7 are similarly enlarged detail views of other, composite posts of this invention and their immediate vicinity in sectional plan. Thus, FIG. 6 shows post 12' as made up of a pair of single-channeled members 6, each having a C-shaped cross-section, arranged back-to-back and spaced apart as an expansion-joint, with elastic strip 16 therebetween. Such strip is covered laterally by bead 38 of caulking material to fill the gap between panel ends. Such expansion-joint construction is useful at intervals along a fence wall, as at about every hundred feet (more or less), so as to compensate for temperature-induced changes in length.

FIG. 7 shows a pair of such simple C-shaped channel members secured together, as by welding, with the base of one covering the ouside wall of a channel of the other and contiguous therewith. End portions of panels 20 fit onto the respective pairs of flanges to form a corner of the fence wall. End portions of both panels outside the corner preferably extend farther than corresponding inside end portions, or gaps can be filled by adding thin pieces of panel material for continuity of the wall corner surfaces.

Figure 8:
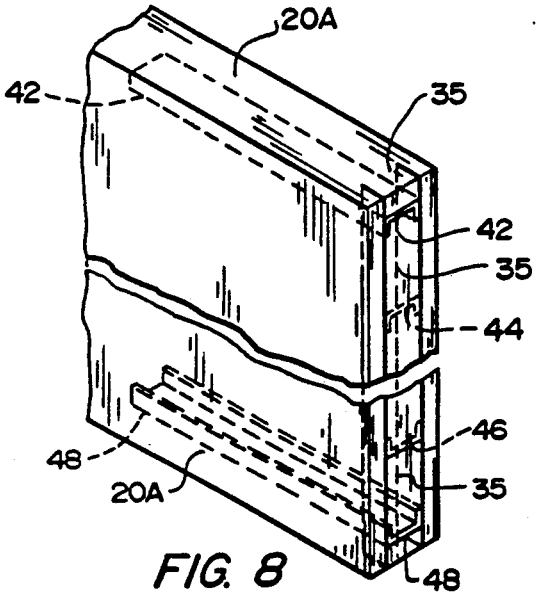
FIG. 8 is a perspective view of a panel modification.

FIG. 8 shows in perspective modified wall panel 20*a*, which has embedded within its plastic foam body an upright lower channel 48 and an inverted upper channel 42 for reinforcement. Indicated in broken lines are similar intervening upper and lower channels 44 and 46. The outside embedded channel width is narrow enough not to interfere with slotting of the vertical edges of such panel to receive the post flanges just as before. Reinforcing screen is absent as the channels enable the panels to carry the weight of the protective layers quite handily. Lower embedded channel 48 also limits the potential distortion of the bottom edge of the panels at the stops in the post flanges when carrying the coating weight.

Figure 9:
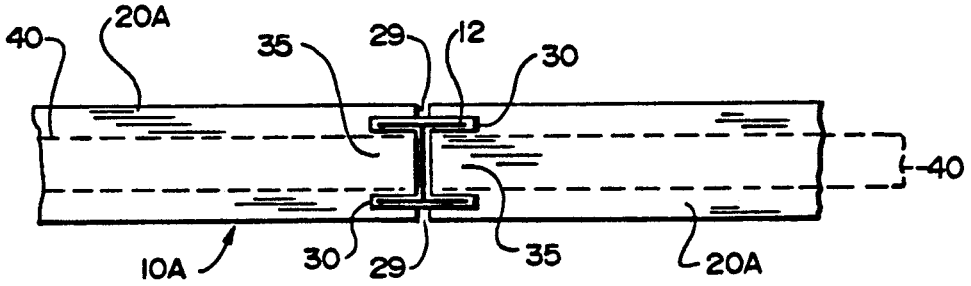
FIG. 9 is a fragmentary plan view of an assembly of panels, modified as in FIG. 8, to a post in forming a modified fence wall of this invention.

FIG. 9 shows from above, fragmentarily and without any cap, straight fence wall 10*a*, comprising alternative panels 20*a* fitted to I-beam post 12, with the flanges of the post within the slots in the vertical edges of the respective panels. Coating is omitted as superfluous to illustration at this stage of assembly.

Not shown in the foregoing views are corner constructions other than rectangular, but it will be apparent that a pair of channels can be secured to one another at other angles and/or the space in between be filled to make a smooth oblique wall junction.

The materials used in construction of such fence walls of this invention are all made from conventional components and are readily available in the marketplace. Thus, the posts are conveniently metallic, usually galvanized steel. Such posts are suitable in 18 gauge up to about 6 feet in fence height and 10 feet in post length (including underground portion), and in suitably heavier gauges (such as 8 to 16) to about 10 feet high and 16 feet long, dependent upon soil type and wind velocity as well as fence height. The base of each post is embedded in a cylindrical concrete footing about a foot in diameter.

The panels are made of suitable foamed polymeric composition, such as expanded polystyrene or polyurethane (more expensive). The caps are made of similar, preferably unfoamed, polymeric material, or they may be made of stone or other appropriate material. They are secured by mortar or in any other suitable manner.

The inner layer or base coat—which may be the only one—of protective material usually is a mainly a cementitious grout, with a low-alkali portland cement base, plus admixture of a substantial part of elastomeric polymer, such as a viny-acrylic or an epoxy resin, preferably reinforced by fibrous material mixed thereinto, such as glass or polyalkylene fibers, plus an expansible siliceous or other mineral aggregate capable of reducing the density of the resulting product.

The reinforcing fabric may be made of metallic wire, glass, or polymeric composition, as preferred, in any suitably open-mesh form.

In overall appearance, the fence walls of this invention are as attractive as those made in any other way. They require less maintenance because they do not crack in the manner of concrete block walls (when the ground supporting them shifts underneath). The weight of the walls of this invention is carried by the posts, which are in footings massive and extensive enough not to shift. Such walls may be made to follow the grade or may bridge swales, culverts, or like gaps by increasing post length if necessary and setting the supporting stops in the posts to level the panels.

In performance, the fence walls of this invention meet and usually exceed the customary requirements for impact strength, wind resistance, and other physical characteristics. Although new and somewhat unorthodox, these fence walls have now been approved by many authorities, especially in the southeastern states, where high winds (and waters) and strong sun exposure impose unusually severe demands upon fencing and walls, particularly fence walls. Other advantages and benefits of the fence walls of this invention have been suggested, and still more will become apparent to persons who construct or use them.

Variants on the basic fence wall structure of this invention have been suggested also. Other modifications made be made, as by adding, combining, or subdividing parts or steps while retaining some of the advantages and benefits of the invention, which itself is defined in the following claims.

The claimed invention is:

1. Method of constructing a fence wall, comprising placing a plurality of flanged fence posts upright and on centers spaced apart at successive intervals, providing a plurality of wall panels of such interval length with slots along and within their opposite ends to receive such post flanges substantially entirely therewithin, and inserting such panels between adjacent pairs of such posts with such flanges received and concealed from the exterior within such slots.

2. In a fence wall having in its structure at least two pairs of supporting flanges in a vertical plane, extending toward one another from respective posts on a pair of spaced centers, the improvement comprising a preformed panel extending substantially the distance between the centers and having substantially parallel vertical wall faces and connecting pairs of vertical and horizontal side edges, the vertical side edges being doubly slotted between and spaced from such faces, each slot so formed beginning along such an edge and extending inside, parallel to, and at locations spaced between such faces to a width and depth corresponding substantially to the flange dimensions, and being thereby adapted to receive the flanges substantially entirely therewithin.

3. Fence wall according to claim 2, including at least one reinforcing channel underlying at least most of the panel and extending substantially the distance between the posts and supported thereby.

4. In a method of fence wall construction, comprising placing a plurality of flanged fence posts upright and on centers spaced apart at successive intervals, and interconnecting successive pairs of flanges with intervening solid panels, the improvement comprising providing such panels of substantially center-to-center length with their vertical edges doubly slotted to receive such flanges therewithin, and inserting successive flanges within such slots of successive panels and thereby concealing such flanges substantially entirely from the exterior.

5. Fence wall constructed according to the method of claim 4.

6. An improved lightweight wall panel having two mutually parallel outer vertical faces of given height, given width, and given thickness, bounded along their perimeter by a pair of vertical side edges and interconnecting horizontal top and bottom edges, each side edge having therein a pair of parallel slots to a given depth, being spaced apart from one another by less than the panel edge thickness and substantially equidistant from the centerline of such edge, the respective pairs of vertical side edge slots being adapted to receive therein and to conceal from the exterior a pair of flanges of upright posts adapted to support such panel.

7. An improved wall panel according to claim 6, including at least one horizontal reinforcing channel extending from one vertical side edge to the other vertical side edge of the panel.

8. An improved wall panel according to claim 6, installed between a pair of upright fence posts each having a pair of parallel flanges facing one another in mutual alignment, the flanges of the respective posts fitting within the slots of the respective vertical edges of the panel, each such flange extending substantially entirely therewithin between the top to the bottom edges of the panel.

* * * * *